US011143460B2

(12) United States Patent
Lin

(10) Patent No.: US 11,143,460 B2
(45) Date of Patent: Oct. 12, 2021

(54) VAPOR CHAMBER STRUCTURE

(71) Applicant: ASIA VITAL COMPONENTS CO., LTD., New Taipei (TW)

(72) Inventor: Sheng-Huang Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 47 days.

(21) Appl. No.: 16/033,180

(22) Filed: Jul. 11, 2018

(65) Prior Publication Data

US 2020/0018555 A1 Jan. 16, 2020

(51) Int. Cl.
*F28D 15/02* (2006.01)
*F28D 15/04* (2006.01)

(52) U.S. Cl.
CPC ..... *F28D 15/0266* (2013.01); *F28D 15/0233* (2013.01); *F28D 15/04* (2013.01)

(58) Field of Classification Search
CPC .. F28D 15/0266; F28D 15/04; F28D 15/0233; F28D 15/0241
See application file for complete search history.

(56) References Cited

U.S. PATENT DOCUMENTS 6,257,328 B1 * 7/2001 Fujiwara ..... F28F 13/00 165/185
6,352,104 B1 * 3/2002 Mok ..... H01L 23/427 165/104.33
7,799,428 B2 * 9/2010 Fujiwara ..... G06F 1/203 165/185
9,036,353 B2 * 5/2015 Buckman ..... H05K 7/20254 361/719
2014/0182819 A1 * 7/2014 Yang ..... F28D 15/04 165/104.26
2015/0168078 A1 * 6/2015 Yang ..... F28D 15/04 165/104.26
2016/0018139 A1 * 1/2016 Olsson ..... F25B 21/02 62/3.3
2016/0088769 A1 * 3/2016 Hsiao ..... G06F 1/20 361/700
2016/0123678 A1 * 5/2016 Hulse ..... H01L 23/427 165/104.21
2017/0227297 A1 * 8/2017 Wang ..... B23P 15/26
2017/0254600 A1 * 9/2017 Sun ..... F28D 15/0233
2017/0328646 A1 * 11/2017 Zhou ..... F28D 15/0266
(Continued)

FOREIGN PATENT DOCUMENTS

CN 2775836 Y 4/2006
CN 201207780 Y 3/2009
(Continued)

*Primary Examiner* — Jon T. Schermerhorn, Jr.
(74) *Attorney, Agent, or Firm* — Bradley J. Thorson; DeWitt LLP

(57) ABSTRACT

A vapor chamber structure includes a main body. The main body has a first section, a second section, a capillary structure and a working fluid. The first section has a first chamber. The second section has a second chamber. The second section extends from one end of the first section in a direction away from the first section. The capillary structure is disposed on inner surfaces of the first and second chambers. The working fluid is filled in the first and second chambers. The vapor chamber structure has both heat spreading effect and remote end heat dissipation effect.

9 Claims, 6 Drawing Sheets

(56) References Cited

U.S. PATENT DOCUMENTS

| | | | | |
|---|---|---|---|---|
| 2017/0363366 | A1* | 12/2017 | Tan | F28D 15/0275 |
| 2018/0017335 | A1* | 1/2018 | Lin | H01L 23/427 |
| 2018/0087844 | A1* | 3/2018 | Huang | F28F 3/12 |
| 2018/0292145 | A1* | 10/2018 | Sun | F28D 15/046 |

FOREIGN PATENT DOCUMENTS

| | | | |
|---|---|---|---|
| CN | 201540050 | U | 8/2010 |
| CN | 202083258 | U | 12/2011 |
| CN | 203120347 | U | 8/2013 |
| CN | 205980889 | U | 2/2017 |
| CN | 107148192 | A | 9/2017 |
| CN | 108156791 | A | 6/2018 |
| TW | M383283 | U1 | 6/2010 |
| TW | M472181 | U | 2/2014 |
| TW | M517318 | U | 2/2016 |

* cited by examiner

VAPOR CHAMBER STRUCTURE

BACKGROUND OF THE INVENTION

1. Field of the Invention

The present invention relates generally to a vapor chamber structure, and more particularly to a vapor chamber structure having both face-to-face heat spreading effect and remote end heat dissipation effect.

2. Description of the Related Art

Currently, the most often used heat dissipation components include heat sinks, heat pipes, heat plates, vapor chambers, etc., wherein the heat sinks mainly serve to help in dissipating the heat, while the heat pipes, heat plates and vapor chambers are able to quickly conduct heat and thus serve as heat conduction components. The heat conduction components have high heat conduction coefficient so that they can serve as the main components in direct contact with the heat source. The heat conduction components can be additionally connected with the heat sinks with better heat dissipation effect so as to enhance the heat dissipation efficiency.

As aforesaid, the vapor chamber and the heat pipe are major heat conduction components with better heat conduction effect. The vapor chamber and the heat pipe need to additionally cooperate with the heat dissipation components with better heat dissipation effect such as radiating fins or heat sinks so as to achieve better heat dissipation effect.

The vapor chamber is a face-to-face large-area heat conduction component, while the heat pipe is an axial remote end heat conduction component for dissipating heat. The working principles of the vapor chamber and the heat pipe are the same. However, the heat conduction directions of the vapor chamber and the heat pipe are different. Some manufacturers combine the vapor chamber and the heat pipe by means of overlapping or lapping or welding to conduct heat so as to achieve both large-area heat conduction effect and remote end heat conduction effect. However, in case the vapor chamber and the heat pipe are connected with each other by means of welding, a gap will exist between the vapor chamber and the heat pipe to cause thermal resistance. This will deteriorate the heat conduction efficiency.

It is therefore tried by the applicant to provide a vapor chamber structure in which the functions of the vapor chamber and the heat pipe or the other heat dissipation components are integrated to achieve both large-area heat conduction effect and remote end heat conduction effect without causing thermal resistance.

SUMMARY OF THE INVENTION

It is therefore a primary object of the present invention to provide a vapor chamber structure, which has both large-area heat spreading effect and remote end heat conduction effect.

To achieve the above and other objects, the vapor chamber structure of the present invention includes a main body. The main body is composed of a first plate body and a second plate body overlapped and connected with each other. The main body has a first section, a second section, a capillary structure and a working fluid.

The first section has a first chamber. The second section has a second chamber. The second section extends from one end (or one side) of the first section in a direction away from the first section. The capillary structure is disposed on inner surfaces of the first and second chambers. The working fluid is filled in the first and second chambers.

According to the arrangement of the vapor chamber structure, the large-area heat spreading effect and remote end heat conduction effect are integrated so that the first and second sections of the vapor chamber structure can respectively provide large-area heat spreading effect and remote end heat conduction effect without the phenomenon of thermal resistance. Therefore, the heat dissipation performance is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
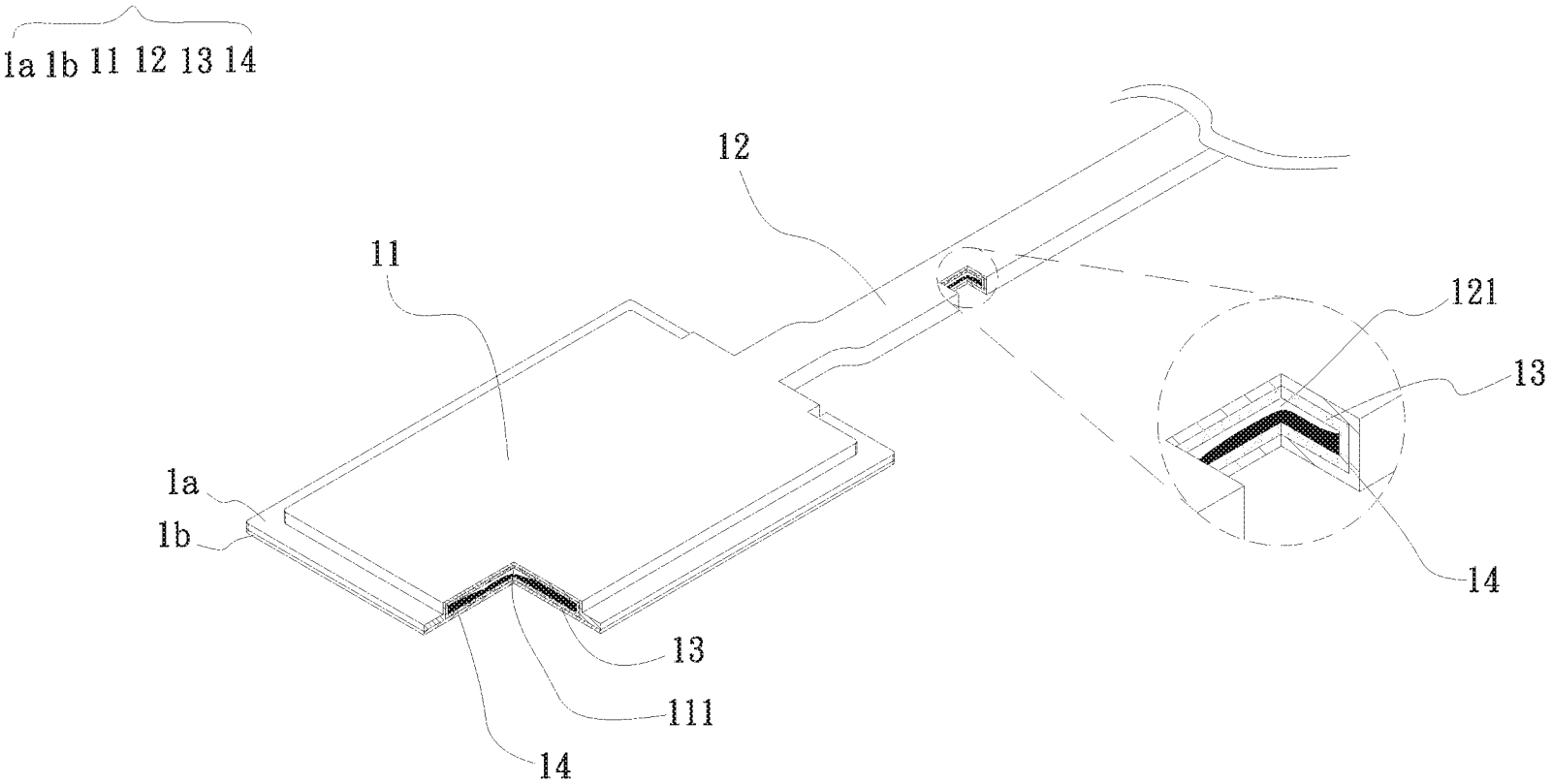
FIG. 1 is a perspective sectional view of a first embodiment of the vapor chamber structure of the present invention.

Please refer to FIG. 1, which is a perspective sectional view of a first embodiment of the vapor chamber structure of the present invention. According to the first embodiment, the vapor chamber structure of the present invention includes a main body 1.

The main body 1 is composed of a first plate body 1*a* and a second plate body 1*b* overlapped and connected with each other. The main body 1 has a first section 11, a second section 12, a capillary structure 13 and a working fluid 14.

The first section 11 has a first chamber 111. The first section 11 has the form of a flat cuboidal body. The first section 11 serves to conduct heat by large area.

The second section 12 has a second chamber 121. The second section 12 extends from one end (or one side) of the first section 11 in a direction away from the first section 11. In comparison with the configuration of the first section 11, the second section 12 has the form of an elongated cuboidal body or an elongated cylindrical body or any elongated geometric body.

The capillary structure 13 is disposed on the inner surfaces of the first and second chambers 111, 121. That is, the capillary structure 13 is disposed on the surfaces of the internal chambers of the first and second sections 111, 121. The working fluid 14 is filled in the first and second chambers 111, 121.

The second section 12 can extend to a desired position in accordance with the usage of a user. The first and second sections 11, 12 are integrated into a structure having both large-area heat-spreading effect and remote end heat conduction effect. Therefore, the first section 11 has the form of a flat cuboidal body for face-to-face conducting and spreading heat by large area, while the second section 12 has the form of an elongated cuboidal body or an elongated cylindrical body or any elongated geometric body so as to transfer the heat of the first section 11 to a remote end for heat exchange and dissipating the heat. According to such design, the advantage of large-area heat conduction of the vapor chamber and the advantage of remote end heat conduction of the heat pipe are integrated. This improves the shortcoming of the conventional device that the vapor chamber and the heat pipe are combined by way of lapping or welding to cause thermal resistance.

Figure 2:
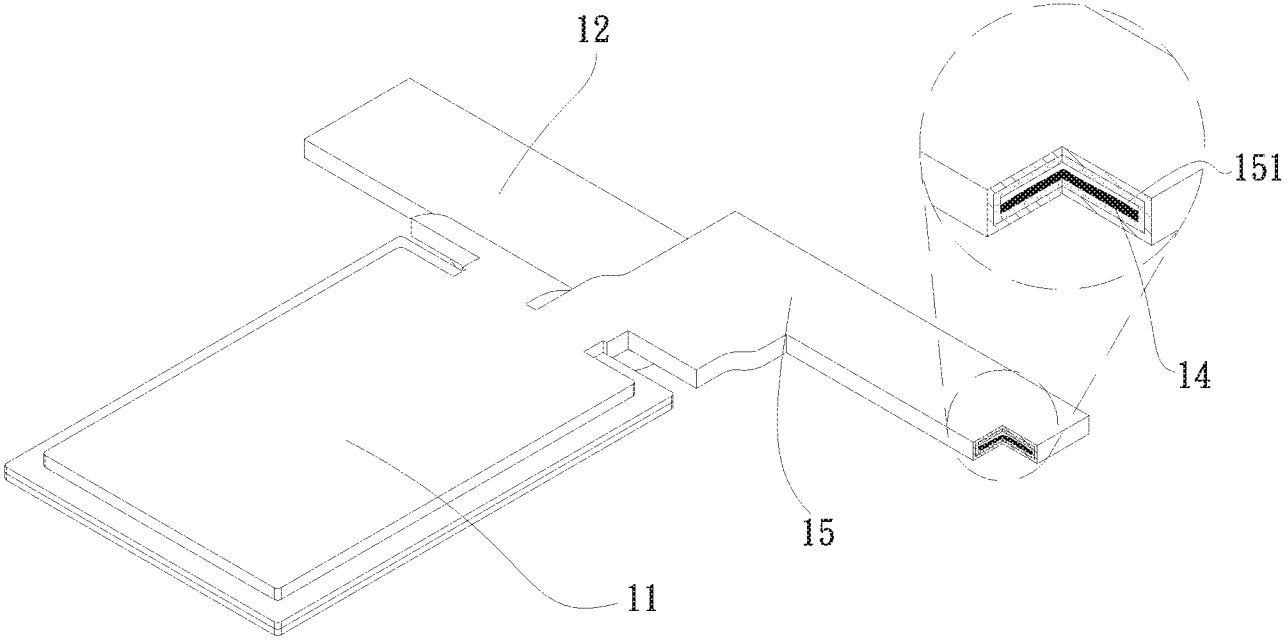
FIG. 2 is a perspective sectional view of a second embodiment of the vapor chamber structure of the present invention.
Figure 2A:
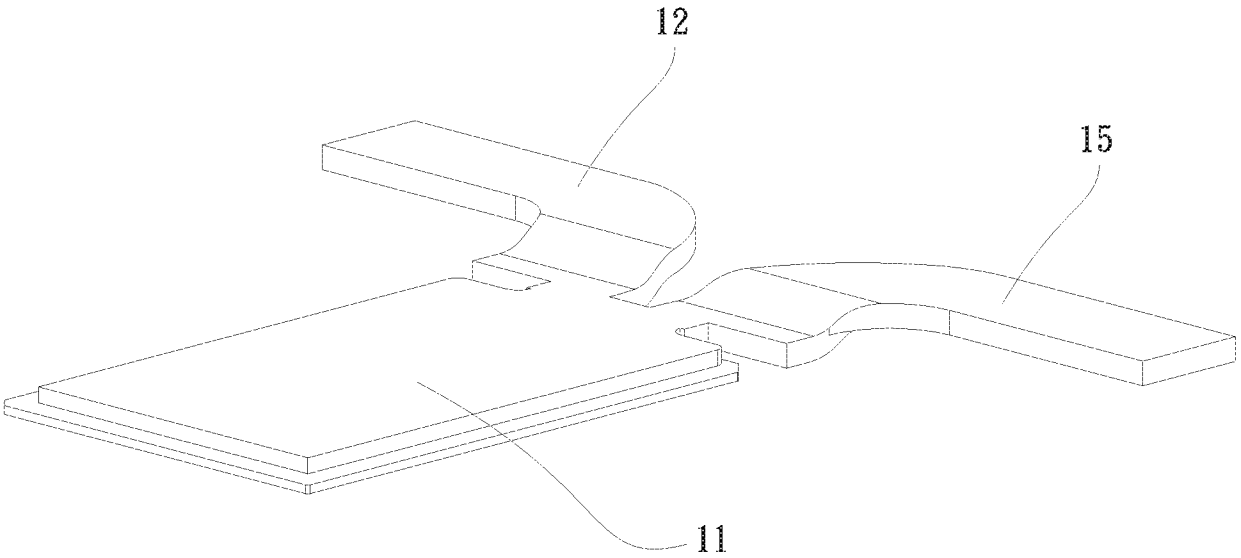
FIG. 2*a* is a perspective sectional view of the second embodiment of the vapor chamber structure of the present invention.

Please now refer to FIGS. 2 and 2*a*. FIG. 2 is a perspective sectional view of a second embodiment of the vapor chamber structure of the present invention. FIG. 2*a* is a perspective sectional view of the second embodiment of the vapor chamber structure of the present invention. The second embodiment is partially identical to the first embodiment in structure and thus will not be redundantly described hereinafter. The second embodiment is different from the first embodiment in that a third section 15 extends from one end of the first section 11. The third section 15 has a third chamber 151. The capillary structure 13 extends to the third chamber 151 to be also disposed on the inner surface of the third chamber 151. The working fluid 14 is partially filled in the third chamber 151. The second and third sections 12, 15 and the first section 11 are positioned on different levels. Under such circumstance, in case there are obstacles in the arrangement site at different heights, the second and third sections 12, 15 can be arranged to avoid the obstacles.

FIG. 2*a* shows another aspect of the second embodiment. As shown in the drawing, the second and third sections 12, 15 are positioned on the same level, while the first section 11 is positioned on a different level. In addition, after outward extending from the first section 11, the second and third sections 12, 15 respectively extend to the left and right sides or upper and lower sides of the first section 11.

Figure 3:
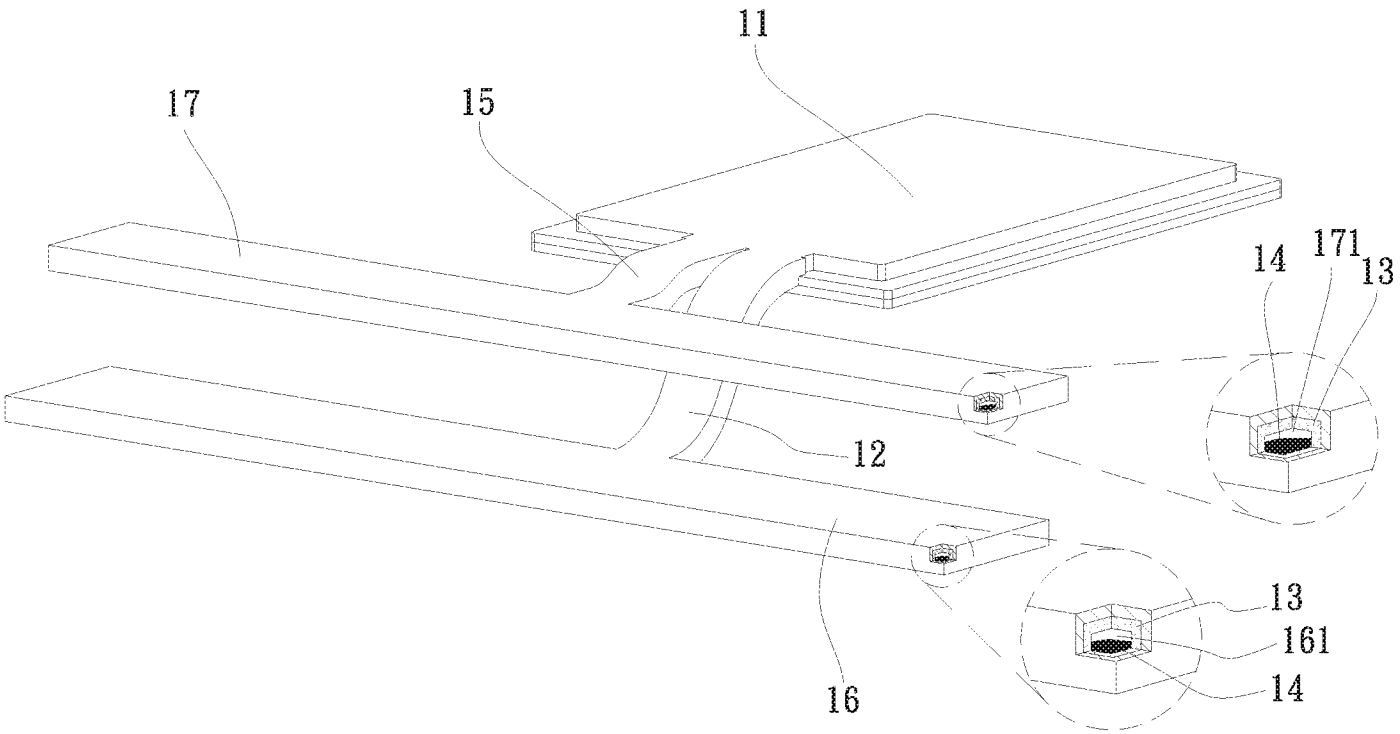
FIG. 3 is a perspective sectional view of a third embodiment of the vapor chamber structure of the present invention.

Please now refer to FIG. 3, which is a perspective sectional view of a third embodiment of the vapor chamber structure of the present invention. The third embodiment is partially identical to the first embodiment in structure and thus will not be redundantly described hereinafter. The third embodiment is different from the second embodiment in that the second section 12 is connected with a fourth section 16. The fourth section 16 has the form of an elongated plate and is perpendicularly connected with the second section 12 and extends to left and right sides of the second section 12. The fourth section 16 has a fourth chamber 161. The capillary structure 13 extends to the fourth chamber 161 to be disposed on the inner wall surface of the fourth chamber 161. The third section 15 is connected with a fifth section 17. The fifth section 17 has the form of an elongated plate and is perpendicularly connected with the third section 15 and extends to left and right sides of the third section 15. The fifth section 17 has a fifth chamber 171. The capillary structure 13 extends to the fifth chamber 171 to be disposed on the inner wall surface of the fifth chamber 171. The first, second, third, fourth and fifth sections 11, 12, 15, 16, 17 are not positioned on the same level (with height difference).

Figure 4:
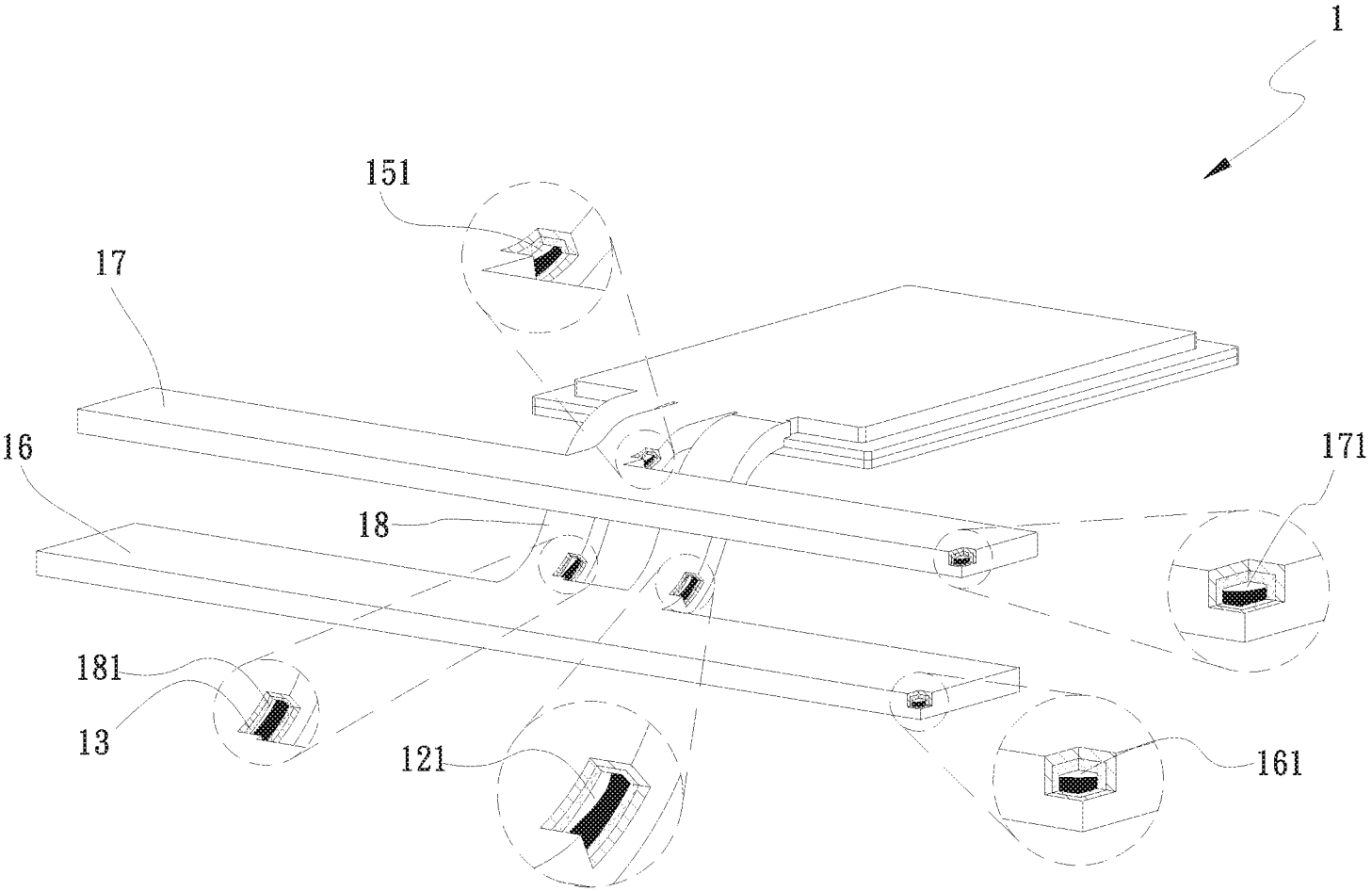
FIG. 4 is a perspective sectional view of a fourth embodiment of the vapor chamber structure of the present invention.
Figure 4A:
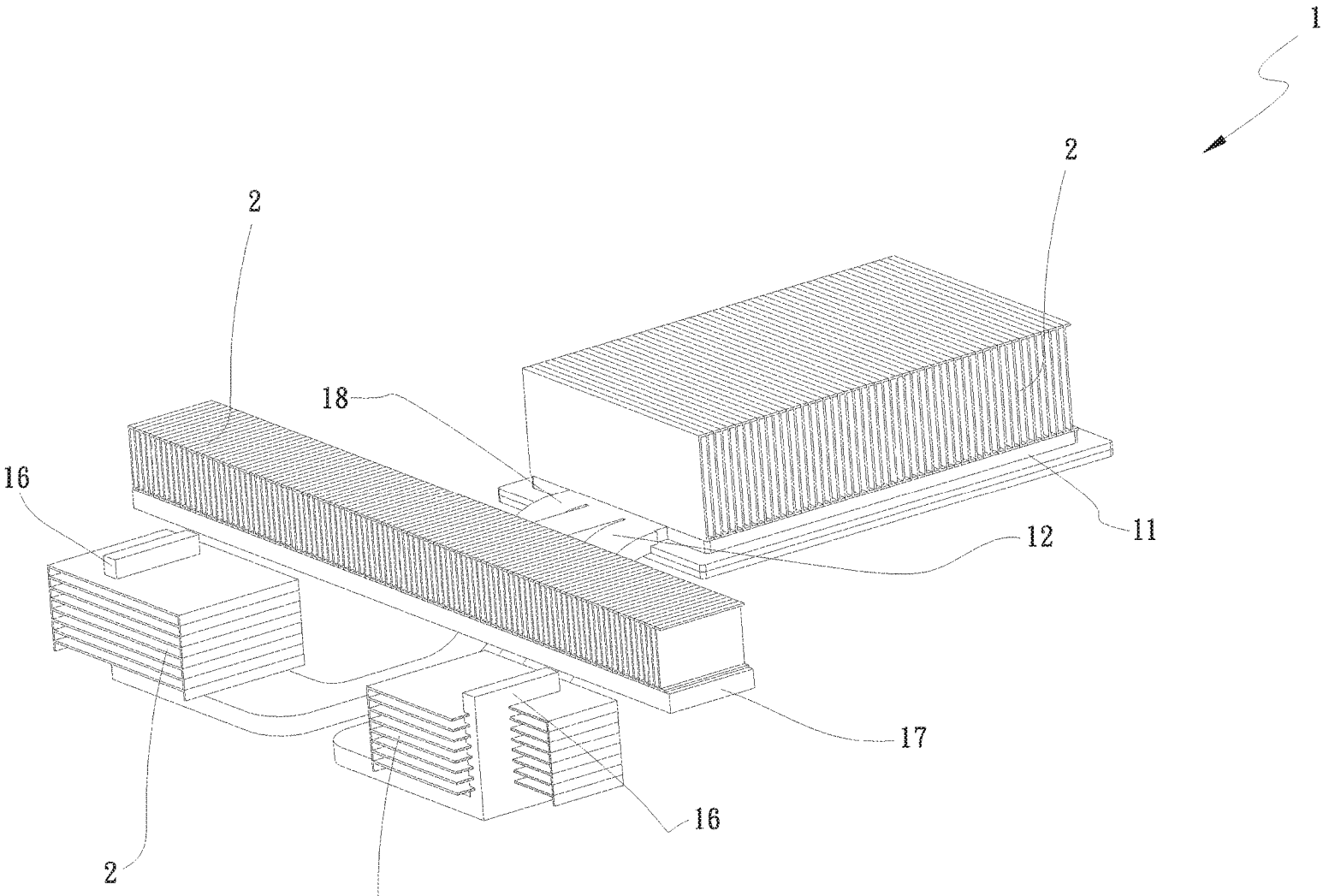
FIG. 4*a* is a perspective sectional view of the fourth embodiment of the vapor chamber structure of the present invention.

Please now refer to FIGS. 4 and 4*a*. FIG. 4 is a perspective sectional view of a fourth embodiment of the vapor chamber structure of the present invention. FIG. 4*a* is a perspective sectional view of the fourth embodiment of the vapor chamber structure of the present invention. The fourth embodiment is partially identical to the first embodiment in structure and thus will not be redundantly described hereinafter. The fourth embodiment is different from the third embodiment in that the main body 1 has a sixth section 18. The sixth section 18 has the form of an elongated plate. Two ends of the sixth section 18 are respectively perpendicularly connected with the first section 11 and the fourth section 16. The sixth section 18 has a sixth chamber 181. The capillary structure 13 extends to the sixth chamber 181 to be disposed on the inner wall surface of the sixth chamber 181. The first, second, third, fourth, fifth and sixth chambers 111, 121, 151, 161, 171, 181 communicate with each other.

FIG. 4*a* shows another aspect of the fourth embodiment. As shown in the drawing, the fourth section 16 is divided along the central section into two parts. One of the two parts of the fourth section 16 is connected with the sixth section 18, while the other of the two parts of the fourth section 16 is connected with the second section 12. That is, in this aspect, the two parts of the fourth section 16 are respectively independently connected with the second and sixth sections 12, 18.

A portion of the fourth section 16 near a rear end thereof is perpendicularly bent to extend. Multiple radiating fins 2 are fitted on the extending portion of the fourth section 16. In this embodiment, the fourth section 16 and the fifth section 17 have a height difference. The position and height of the height difference can be freely adjusted by a designer in accordance with the space to be designed and the corresponding heat source in adaptation to the space. In this embodiment, multiple radiating fins 2 are additionally serially fitted around the fourth and fifth sections 16, 17 in accordance with the designed space with the height difference. Moreover, multiple radiating fins 2 are disposed on the other side of the first section 11 opposite to the side in contact with the heat source. The radiating fins 2 serve to enhance the heat dissipation effect. In addition, the radiating fins 2 arranged on the respective sections are directed in different directions so that the heat can be dissipated by way of radiation in different directions without the phenomenon of accumulation of heat.

According to the arrangement of the present invention, the vapor chamber structure has two major portions, which provide heat conduction structures having both large-area heat conduction effect and remote end heat conduction effect. This solves the shortcoming of the conventional device that the vapor chamber and the heat pipe are combined by way of lapping or welding to cause thermal resistance. In addition, the internal chambers of the portions communicate with each other so that the heat can be conducted more quickly. Also, in addition to the large-area heat absorption effect and remote end heat conduction effect, the vapor chamber structure of the present invention is co-used with other heat dissipation components (such as radiating fins or heat sinks). Accordingly, the heat can be quickly conducted to the cooperative heat dissipation components to enhance the heat dissipation efficiency.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A vapor chamber structure comprising:

a main body comprising:

a first chamber having the form of a flat cuboidal body with a heat spreading surface;

a first heat conducting tubular portion extending from the first chamber in a direction away from the first chamber and having a second chamber communicating with the first chamber;

a second heat conducting tubular portion extending from the first chamber and having a third chamber communicating with the first chamber;

wherein the first heat conducting tubular portion and the second heat conducting tubular portion have the form of an elongated cuboidal body or an elongated cylindrical body or any elongated geometric body, and wherein by means of linear conduction, heat is transferred from the first chamber to a remote end of the first heat conducting tubular portion and a remote end of the second heat conducting tubular portion for heat exchange and dissipating the heat, and wherein the remote ends of the first heat conducting tubular portion and the second heat conducting tubular portion are positioned at different heights relative to the main body, and the remote ends of the first heat conducting tubular portion and the second heat conducting tubular portion are arranged at different heights and toward same direction or different directions;

a capillary structure disposed on inner surfaces of the first, second, and third chambers; and a working fluid filled in the first, second, and third chambers.

2. The vapor chamber structure as claimed in claim 1, wherein a second heat conducting tubular portion extends from one end of the first chamber, the second heat conducting tubular portion having a third chamber, the capillary structure extending to the third chamber to be also disposed on the inner surface of the third chamber, the working fluid being partially filled in the third chamber.

3. The vapor chamber structure as claimed in claim 2, wherein the second chamber and the third chamber are not positioned on the same level as the first chamber.

4. The vapor chamber structure as claimed in claim 2, wherein the second section is connected with a fourth section, the fourth section having the form of an elongated plate and being perpendicularly connected with the second section and extending to left and right sides of the second section, the fourth section having a fourth chamber, the capillary structure extending to the fourth chamber to be disposed on inner wall surface of the fourth chamber, the third section being connected with a fifth section, the fifth section having the form of an elongated plate and being perpendicularly connected with the third section and extending to left and right sides of the third section, the fifth section having a fifth chamber, the capillary structure extending to the fifth chamber to be disposed on inner wall surface of the fifth chamber.

5. The vapor chamber structure as claimed in claim 4, wherein the first, second, third, fourth and fifth sections are not positioned on the same level.

6. The vapor chamber structure as claimed in claim 4, wherein the main body has a sixth section, the sixth section having the form of an elongated plate, two ends of the sixth section being respectively perpendicularly connected with the first section and the fourth section, the sixth section having a sixth chamber, the capillary structure extending to the sixth chamber to be disposed on inner wall surface of the sixth chamber.

7. The vapor chamber structure as claimed in claim 6, wherein the first, second, third, fourth, fifth and sixth chambers communicate with each other.

8. The vapor chamber structure as claimed in claim 6, wherein a portion of the fourth section near a rear end thereof is perpendicularly bent to extend, multiple radiating fins being fitted on the extending portion of the fourth section.

9. The vapor chamber structure as claimed in claim 1, wherein multiple radiating fins are disposed on one side of the first chamber.

* * * * *